US008662618B2

(12) United States Patent
Okamoto et al.

(10) Patent No.: US 8,662,618 B2
(45) Date of Patent: Mar. 4, 2014

(54) PRINTING APPARATUS AND JAM RESTORATION METHOD IN PRINTING APPARATUS

(75) Inventors: Takayuki Okamoto, Kawasaki (JP); Masahito Yoshida, Shiki (JP); Kota Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 487 days.

(21) Appl. No.: 12/957,297

(22) Filed: Nov. 30, 2010

(65) Prior Publication Data

US 2011/0211007 A1 Sep. 1, 2011

(30) Foreign Application Priority Data

Feb. 26, 2010 (JP) ..... 2010-042344

(51) Int. Cl.
*B41J 29/38* (2006.01)

(52) U.S. Cl.
USPC ..... 347/16; 347/14; 347/19; 347/101; 347/104; 347/105

(58) Field of Classification Search
None
See application file for complete search history.

(56) References Cited

U.S. PATENT DOCUMENTS 5,905,520 A * 5/1999 Fujii et al. ..... 347/153

FOREIGN PATENT DOCUMENTS

| | | | |
|---|---|---|---|
| JP | 07-264348 | A | 10/1995 |
| JP | 11-249346 | A | 9/1999 |
| JP | 2002-258415 | A | 9/2002 |
| JP | 2003-039750 | A | 2/2003 |
| JP | 2006-027056 | A | 2/2006 |
| JP | 2008-119935 | A | 5/2008 |
| JP | 2008-126530 | A | 6/2008 |

* cited by examiner

*Primary Examiner* — Uyen Chau N Le
*Assistant Examiner* — Chad Smith
(74) *Attorney, Agent, or Firm* — Canon USA Inc. IP Division

(57) ABSTRACT

In the event that occurrence of a jam has been detected during conveyance of a sheet, the sheet is cut at a cutter unit, and a user is prompted to perform manual jam restoration processing according to the location where the jam has occurred. If the jam has occurred upstream from the cutter unit, the cut sheets left downstream from the cutter unit are discharged as completed articles.

8 Claims, 13 Drawing Sheets

| |
|---|
| FIG. 6A |
| FIG. 6B |

PRINTING APPARATUS AND JAM RESTORATION METHOD IN PRINTING APPARATUS

BACKGROUND OF THE INVENTION

1. Field of the Invention

The present invention relates to a printing apparatus employing a continuous sheet.

2. Description of the Related Art

With Japanese Patent Laid-Open No. 2008-126530, a printing apparatus has been disclosed, which uses a long continuous sheet wound in a rolled state to perform duplex printing on both sides of the sheet by the inkjet method.

With the device according to Japanese Patent Laid-Open No. 2008-126530, restoration processing at the time of a jam occurring during conveyance of a sheet, which prevents conveyance of the sheet, is not taken into consideration at all. Therefore, when a jam occurs, a user has no other choice other than that all of the sheets within the device are removed and discarded, and printing is resumed from the beginning thereof again. That is to say, occurrence of a jam increases waste of sheets and ink, and also increases effort and time for jam restoration work.

The present invention has been made in light of the above issues. The present invention provides a printing apparatus capable of resuming printing by reducing waste of sheets and ink as much as possible even when a jam occurs during printing. The present invention also provides a printing apparatus capable of resuming printing by reducing a user's effort and time for jam restoration processing as much as possible even when a jam occurs during printing.

SUMMARY OF THE INVENTION

An apparatus is provided including: a sheet feeding unit configured to feed a sheet, wherein the sheet is continuous; a print unit configured to perform printing on the sheet fed from the sheet feeding unit; a cutter unit configured to cut the sheet printed at the print unit; a detecting unit configured to detect a jam occurred when the sheet being conveyed; and a control unit configured to control such that, in the event that the detecting unit detects the jam, the cutter unit cuts a sheet, and also prompts a user to perform manual jam restoration processing according to the location where the jam has occurred.

According to the present invention, waste of sheets and ink can be reduced as much as possible even when a jam occurs during printing. Also, effort and time for jam restoration processing can be reduced as much as possible.

Further features of the present invention will become apparent from the following description of exemplary embodiments with reference to the attached drawings.

DESCRIPTION OF THE EMBODIMENTS

Hereafter, embodiments of a printing apparatus using the inkjet method will be described. The printing apparatus of the present embodiment is a high-speed line printer which can handle both of simplex printing and duplex printing using a long continuous sheet (long continuous sheet longer than the length of repetition print units (also called one page or unit image) in the conveying direction). For example, this printing apparatus is adapted to a field for printing a great number of sheets in a print lab or the like. Note that, with the present Specification, even when multiple small images, letters, or blanks are mixed in a one print unit (one page) region, all included in this region are referred to as one unit image. That is to say, a unit image means one print unit (one page) in the event of successively printing multiple pages on a continuous sheet. The length of a unit image differs according to an image size to be printed. For example, with a photo of L size, the length in the sheet conveying direction is 135 mm, and with A4 size, the length in the sheet conveying direction is 297 mm.

The present invention may widely be applied to a printing apparatus such as a printer, a multi-function printer, a copying machine, a facsimile apparatus, a manufacturing device of various types of device, and so forth. The print processing is not restricted to any method, and may be an inkjet method, electrophotography method, thermal transfer method, dot-impact method, liquid development method, or the like. Also, the present invention is not restricted to print processing, and may be applied to a sheet processing device which subjects a continuous sheet to various types of processing (recording, processing, coating, irradiation, scanning, inspection, and so forth).

Figure 1:
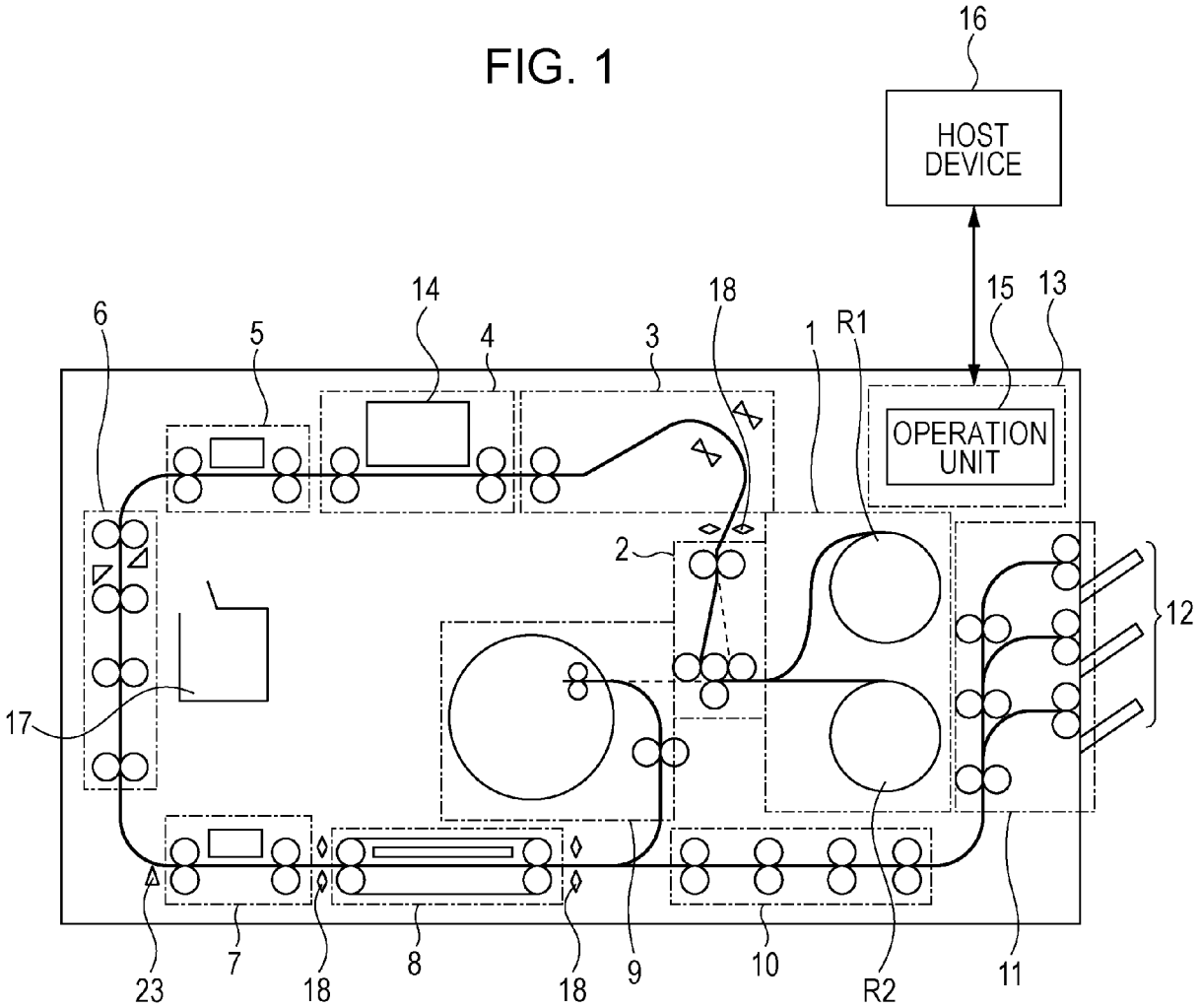
FIG. 1 is a schematic view illustrating the internal configuration of a printing apparatus.

FIG. 1 is a schematic view illustrating the internal configuration of the printing apparatus. The printing apparatus according to the present embodiment is capable of using a sheet wound in a rolled state to perform duplex printing on a first surface of the sheet and a second surface on the back face side of the first surface. The printing apparatus principally includes each unit of a sheet feeding unit 1, a decurling unit 2, a skew correcting unit 3, a print unit 4, an inspection unit 5, a cutter unit 6, an information recording unit 7, a drying unit 8, a reverse unit 9, a discharge conveying unit 10, a sorter unit 11, a discharge unit 12, and a control unit 13. The sheet is conveyed by a conveying mechanism made up of a roller pair and a belt and so forth along a sheet conveying path indicated with a solid line in the drawing, and is processed at each unit. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The sheet feeding unit 1 is a unit for holding and feeding a continuous sheet wound in a rolled state. The sheet feeding unit 1 is capable of housing two rolls R1 and R2, and has a configuration for alternatively paying out sheets to be fed. Note that the number of rolls to be housed is not restricted to two, and one or three or more may be housed. The sheet is not restricted to a sheet wound in a rolled state as long as the sheet is a continuous sheet. For example, a sheet may be employed wherein a continuous sheet perforated for each unit length is folded and layered for each perforation, and is housed in the sheet feeding unit 1.

The decurling unit 2 is a unit for reducing curling (warping) of the sheet fed from the sheet feeding unit 1. With the decurling unit 2, curling is reduced by decurling force being influenced by passing through the sheet in a bent manner so as to provide the warping in the opposite direction using two pinch rollers as to one driving roller. The decurling unit 2 is capable of adjusting decurling force, which will be described later.

The skew correcting unit 3 is a unit for correcting skewing of the sheet having passed through the decurling unit 2 (angle as to the true direction of travel). Skewing of the sheet is corrected by pressing a sheet edge portion on the side serving as a reference against a guide member.

The print unit 4 is a sheet processing unit for subjecting a sheet to be conveyed to print processing by a print head 14 from above to form an image. That is to say, the print unit 4 is a processing unit for subjecting the sheet to predetermined processing. The print unit 4 also includes multiple conveying rollers to convey a sheet. The print head 14 includes a line-type print head where a nozzle train of the inkjet method is formed in a range covering the maximum width of a sheet to be used. With the print head 14, multiple print heads are arrayed in parallel along the conveying direction. With the present example, the print head 14 includes seven print heads corresponding to seven colors of C (cyan), M (magenta), Y (yellow), LC (light cyan), LM (light magenta), G (gray), and K (black). Note that the number of colors, and the number of print heads are not restricted to seven. As for the inkjet method, there may be employed a method using a heater element, a method using a piezo-electric element, a method using an electrostatic device, a method using an MEMS element, or the like. The ink of each color is fed to the print head 14 via the corresponding ink tube from an ink tank. With the print unit 4, the print head 14 is arranged to be movable in a direction to be evacuated from the sheet, which will be described later. Thus, the interval of the print head 14 as to the sheet is adjusted.

The inspection unit 5 is a unit for optically scanning a test pattern or image printed on a sheet at the print unit 4 by a scanner to determine whether the image has correctly been printed by inspecting the states of the nozzles of the print head, sheet conveying state, image position, and so forth. The scanner includes a CCD image sensor or CMOS image sensor.

The cutter unit 6 is a unit including a mechanical cutter (auto cutter) for cutting a sheet after printing into a predetermined length by the driving force of the motor. The cutter unit 6 also includes multiple conveying rollers for feeding out the sheet to the next process. A trash box 17 is provided to the neighborhood of the cutter unit 6. The trash box 17 is for housing a small sheet piece to be cut off at the cutter unit 6 and discharged as trash. With the cutter unit 6, there is provided a sorting mechanism regarding whether the cut sheets are discharged to the trash box 17 or proceed to the original conveying path.

Also, apart from the auto cutter, a manual cutter 18 for the user manually cutting a sheet is provided at least between the reverse unit 9 and the print unit 4. The manual cutter 18 is operated by the user, in the event that a jam has occurred and an error which requires cutting of a sheet such as a paper jam, to cut and remove the sheet from the casing of the device. With the present embodiment, on the upstream side of the cutter unit 6, the manual cutter 18 is provided to one location between the decurling unit 2 and the sheet correcting unit 3 in front of the print head. On the downstream side of the cutter unit 6, the manual cutter 18 is provided to two locations before and after the drying unit 8.

The information recording unit 7 is a unit for recording print information (unique information) in a non-print region of the cut sheet, such as the serial number or date or the like of printing. Recording is performed by printing characters or code by the inkjet method or thermal transfer method or the like. A sensor 23 for detecting the leading edge of the cut sheet is provided to the upstream side of the information recording unit 7 and the downstream side of the cutter unit 6. That is to say, timing for recording information at the information recording unit 7 is controlled based on the detection timing of the sensor 23 which detects the edge portion of a sheet between the cutter unit 6 and the recorded position by the information recording unit 7.

The drying unit 8 is a unit for heating the sheet printed by the print unit 4 to dry the applied ink in a short period of time. The sheet to be passed through is applied with heated air from at least the lower face side to dry the ink applied face within the drying unit 8. Note that the drying method is not restricted to the method for applying heated air, and may be a method for irradiating electromagnetic waves (such as an ultraviolet ray, infrared ray, or the like) on the sheet front face.

The above sheet conveying path from the sheet feeding unit 1 to the drying unit 8 will be referred to as a first path. The first path has a shape which performs a U-turn between the print unit 4 and the drying unit 8, and the cutter unit 6 is positioned in the middle of the U-turn shape.

The reverse unit 9 is a unit for temporarily winding the continuous sheet of which the front face printing has been completed thereupon to reverse both sides at the time of performing duplex printing. The reverse unit 9 is provided in the middle of a path (loop path) (referred to as "second path") from the drying unit 8 to the print unit 4 via the decurling unit 2 for feeding the sheet passed through the dying unit 8 to the print unit 4 again. The reverse unit 9 includes a winding rotary member (drum) which rotates for winding the sheet thereupon to store this. The continuous sheet of which printing on the front face has been completed has not been cut is temporarily wound around the winding rotary member to be stored. At the time of winding being completed, the winding rotary member rotates in reverse, and the sheet wound thereupon is fed to the decurling unit 2, and is fed to the print unit 4. Both sides of this sheet have been reversed, so the back face can be printed at the print unit 4. More specific operation of duplex printing will be described later.

The discharge conveying unit 10 is a unit for conveying the sheet cut at the cutter unit 6 and dried at the drying unit 8 to transfer the sheet to the sorter unit 11. The discharge conveying unit 10 is provided to a path different from the second path where the reverse unit 9 is provided (referred to as "third path"). In order to selectively guide the sheet conveyed in the first path into any one of the second path and third path, a path switching mechanism having a movable flapper is provided to a branching position of the paths.

The sorter unit 11 and the discharge unit 12 are provided to the side portion of the sheet feeding unit 1 and also the tail end of the third path. The sorter unit 11 is a unit for classifying the printed sheet for each group as appropriate. The classified sheet is discharged to the discharge unit 12 made up of multiple trays. In this way, the third path has a layout where the sheet is passed through the lower side of the sheet feeding unit 1 and is discharged to the opposite side of the print unit 4 and the drying unit 8 sandwiching the sheet feeding unit 1.

As described above, the sheet feeding unit 1 through the drying unit 8 are sequentially provided to the first path. The end of the drying unit 8 is branched into the second path and the third path, the reverse unit 9 is provided in the middle of the second path, and the end of the reverse unit 9 joins the first path. The discharge unit 12 is provided to the tail end of the third path.

The control unit 13 is a unit which manages control of each unit of the whole printing apparatus. The control unit 13 includes a CPU, a storage device, a controller including various types of control unit, an external interface, and an operation unit 15 by which a user performs input/output. The operation of the printing apparatus is controlled based on the command from a host device 16 such as a host computer to be connected to the controller directly or via the external interface.

Figure 2:
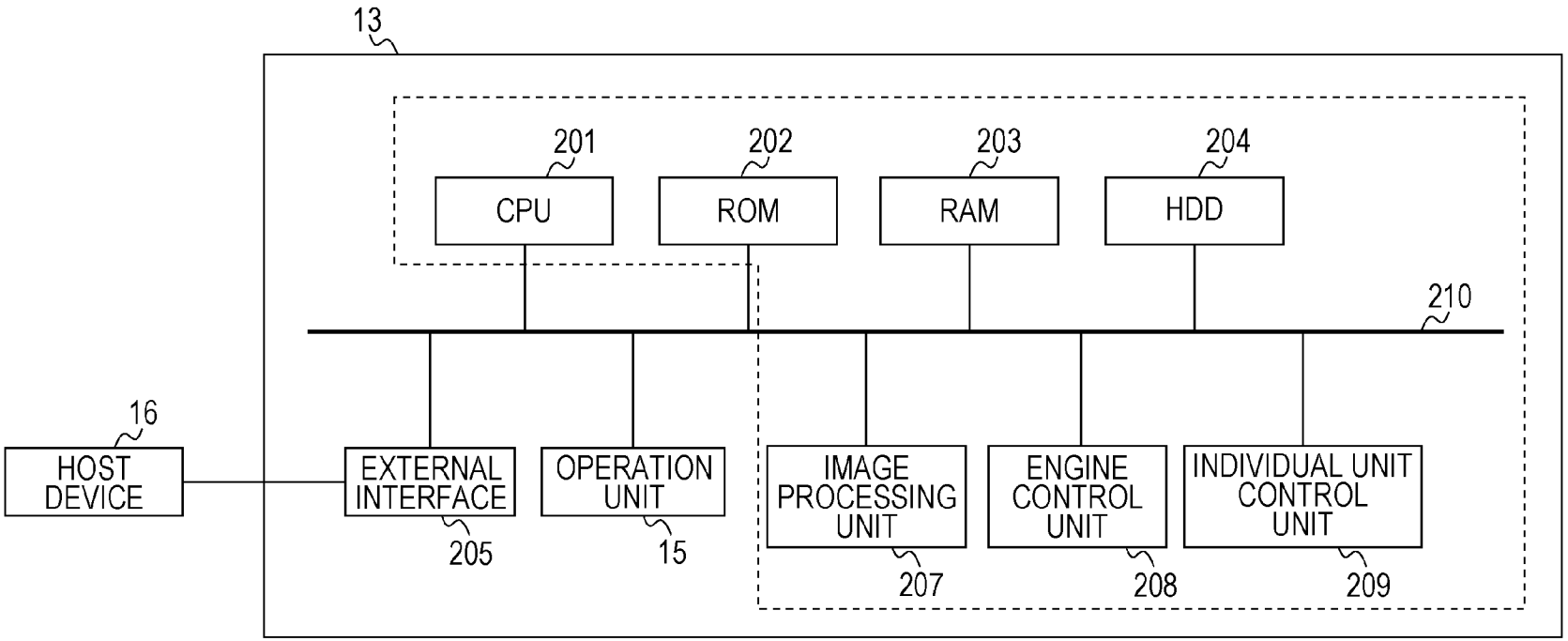
FIG. 2 is a block diagram of a control unit.

FIG. 2 is a block diagram illustrating the concept of the control unit 13. The controller included in the control unit 13 (range surrounded with a dashed line) is configured of a CPU 201, ROM 202, RAM 203, an HDD 204, an image processing unit 207, an engine control unit 208, and an individual unit control unit 209. The CPU 201 (central processing unit) centrally controls the operation of each unit of the printing apparatus. The ROM 202 stores a program to be executed by the CPU 201, and fixed data to be used for various types of operation of the printing apparatus. The RAM 203 is used as the work area of the CPU 201, or used as a temporarily storage region of various types of reception data, or used for storing various types of setting data. The HDD 204 (hard disk) can store or read out a program to be executed by the CPU 201, print data, and setting information used for various types of operation of the printing apparatus. The operation unit 15 is an input/output interface with the user, and includes an input unit such as a hard key or touch panel, and an output unit such as a display for presenting information, an audio generator, or the like.

A dedicated processing unit is provided regarding a unit which requires high-speed data processing. The image processing unit 207 performs the image processing of print data to be handled at the printing apparatus. The image processing unit 207 converts the color space of the input image data (e.g., YCbCr) into standard RGB color space (e.g., sRGB). Also, the image data is subjected to various types of image processing such as resolution conversion, image analysis, image correction, or the like as appropriate. The print data obtained by these image processes is stored in the RAM 203 or HDD 204. The engine control unit 208 performs driving control of the print head 14 of the print unit 4 according to the print data based on the control command received from the CPU 201 or the like. The engine control unit 208 further performs control of the conveying mechanism of each unit within the printing apparatus. The individual unit control unit 209 is a sub controller for individually controlling each unit of the sheet feeding unit 1, decurling unit 2, skew correcting unit 3, inspection unit 5, cutter unit 6, information recording unit 7, drying unit 8, reverse unit 9, discharge conveying unit 10, sorter unit 11, and discharge unit 12. The operation of each unit is controlled by the individual unit control unit 209 based on the command by the CPU 201. The external interface 205 is an interface for connecting the controller to the host device 16, and is a local interface or network interface. The above components are connected by a system bus 210.

The host device 16 is a device serving as the supply source of image data for causing the printing apparatus to perform printing. The host device 16 may be a general-purpose or dedicated computer, or may be dedicated image equipment such as an image capture having an image reader unit, a digital camera, photo storage, or the like. In the event that the host device 16 is a computer, OS, application software for generating image data, and a printer driver for printing apparatus are installed into a storage device included in the computer. Note that it is not essential that all of the above processes are realized by software, so part or all may be realized by hardware.

Next, basic operation at the time of printing will be described. With printing, the operation differs depending on the simplex print mode or the duplex print mode, so each will be described.

Simplex Print Mode

Figure 3:
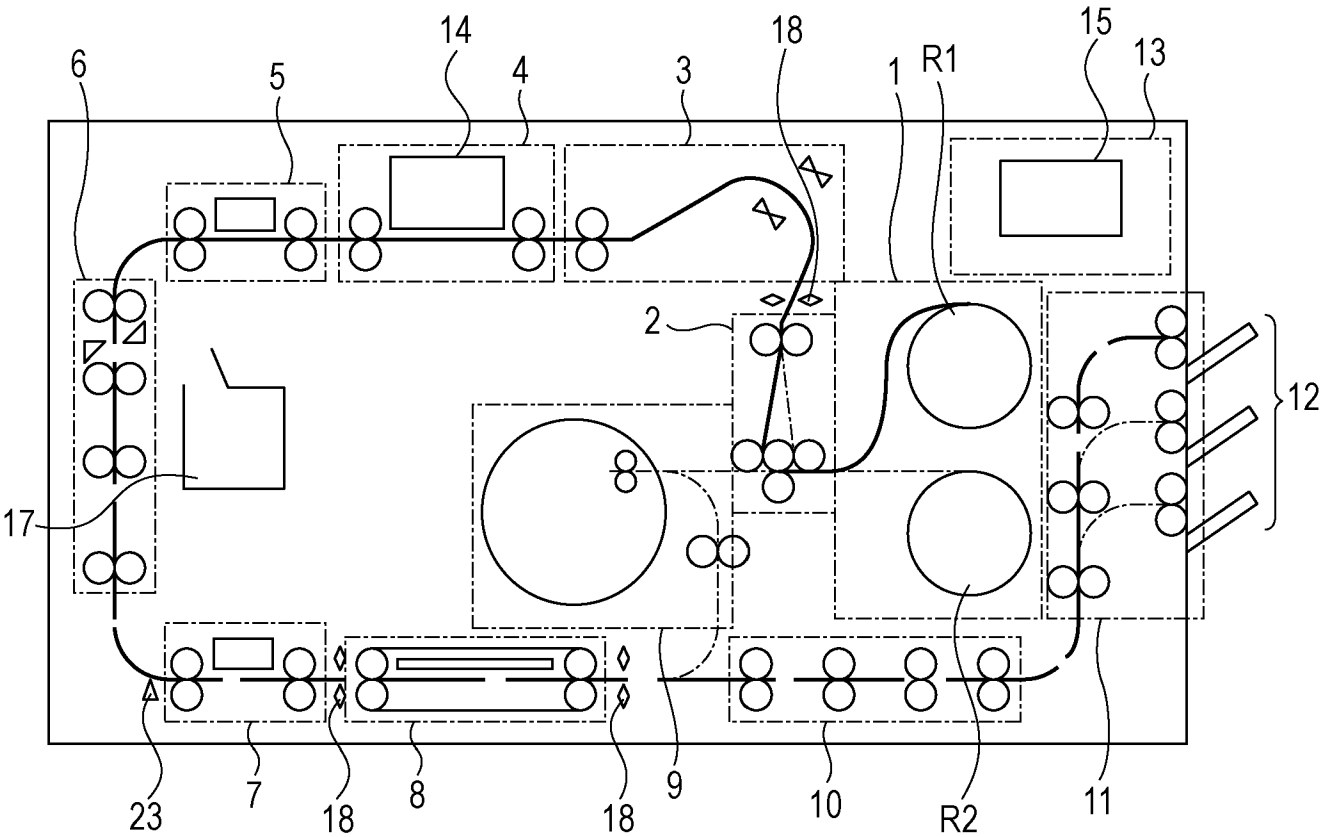
FIG. 3 is a diagram for describing operation in a simplex print mode.

FIG. 3 is a diagram for describing the operation in the simplex print mode. A conveying path of the sheet fed from the sheet feeding unit 1, printed, and discharge to the discharge unit 12 is illustrated with a thick line. With the sheet fed from the sheet feeding unit 1, and processed at each of the decurling unit 2 and skew correcting unit 3, printing of the front face (first surface) is performed at the print unit 4. The image (unit image) of a predetermined unit length in the conveying direction is sequentially printed to array the multiple images as to the long continuous sheet. The printed sheet is cut for each unit image at the cutter unit 6 via the inspection unit 5. With the cut sheets, print information is recorded on the back faces of the sheets by the information recording unit 7 as appropriate. The cut sheets are conveyed to the drying unit 8 one sheet at a time, and are dried. Subsequently, the cut sheets are sequentially discharged to the discharge unit 12 of the sorter unit 11 via the discharge conveying unit 10, and are loaded. On the other hand, the sheets left behind to the print unit 4 side at the time of cutting of the last unit image is fed back to the sheet feeding unit 1, and the sheets are wound around the rolls R1 or R2. At the time of this feeding back, adjustment is performed so as to reduce decurling force at the decurling unit 2, and also the print head 14 is arranged to be evacuated from the sheet, which will be described later.

In this way, with simplex printing, the sheet is passed through the first path and the third path and is processed, but is not passed through the second path. If the above is summarized, with the simplex print mode, the following (1) through (6) sequence is executed by the control of the control unit 13, (1) Feed out the sheet from the sheet feeding unit 1 to feed to the print unit 4;
(2) Repeat printing of a unit image on the first surface of the fed sheet at the print unit 4;
(3) Repeat cutting of the sheet at the cutter unit 6 for each unit image printed on the first surface;
(4) Pass the sheet cut for each unit image through the drying unit 8 one sheet at a time;
(5) Discharge the sheet passed through the drying unit 8 to the discharge unit 12 through the third path one sheet at a time; and
(6) Feed the sheet left behind to the print unit 4 side by the last unit image being cut, back to the sheet feeding unit 1.

Duplex Print Mode

Figure 4:
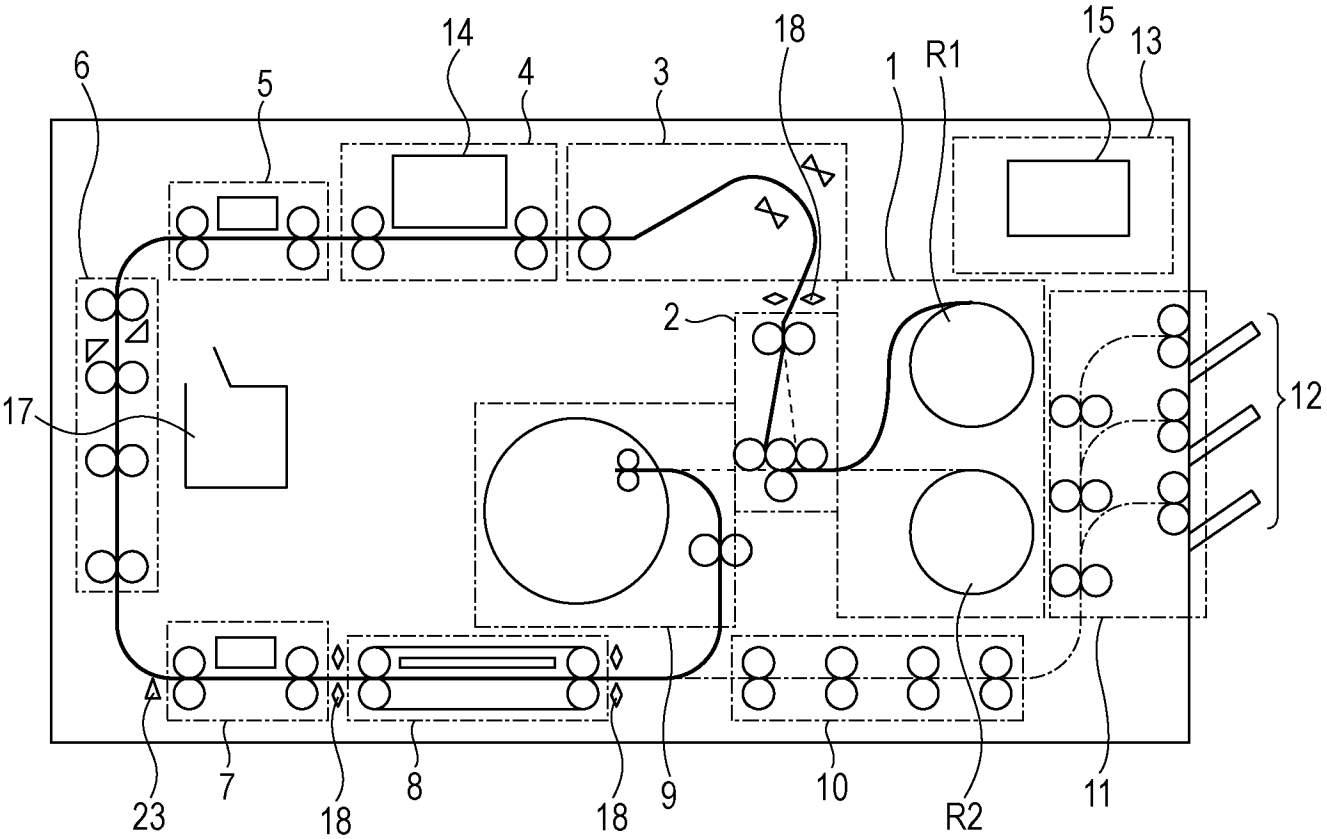
FIG. 4 is a diagram for describing operation in a duplex print mode.

FIG. 4 is a diagram for describing the operation in the duplex print mode. With duplex printing, back face (second surface) print sequence is executed following the front face (first surface) print sequence. With the first front face print sequence, the operation at each unit from the sheet feeding unit 1 to the inspection unit 5 is the same as the operation of the above simplex printing. Cutting operation is not performed at the cutter unit 6, and the sheet is conveyed to the drying unit 8 still in the continuous sheet form. After ink drying of the front face at the drying unit 8, the sheet is guided not to the path on the discharge conveying unit 10 (third path) but to the path on the reverse unit 9 side (second path). With the second path, the sheet is wound around the winding rotary member of the reverse unit 9 which rotates in the forward direction (counter clockwise direction in the drawing). After the scheduled front face printing is all completed at the print unit 4, the trailing edge of the print region of the continuous sheet is cut at the cutter unit 6. The continuous sheet on the conveying direction downstream side (printed side) is all wound around up to the sheet trailing edge (cut position) at the reverse unit 9 through the drying unit 8 with the cut position as a reference. On the other hand, at the same time as the winding at the reverse unit 9, the continuous sheet left behind to the conveying direction upstream side (print unit 4 side) of the cut position is wound back to the sheet feeding unit 1 so that the sheet leading edge (cut position) is not left behind to the decurling unit 2, and the sheet is wound around the rolls R1 or R2. Collision with the sheet to be fed again in the following back face print sequence is avoided according to this feeding back (back feeding). At the time of this feeding back, adjustment is made so as to reduce decurling force at the decurling unit 2, and also the print head 14 is arranged to be evacuated from the sheet, which will be described later.

After the above front face print sequence, the front print sequence is switched to the back face print sequence. The winding rotary member of the reverse unit 9 rotates in the opposite direction (clockwise direction in the drawing) of the direction at the time of being wound thereupon. The edge portion of the sheet wound around (the sheet trailing edge at the time of being wound thereupon becomes the sheet leading edge at the time of being fed back) is fed to the decurling unit 2 along the path indicated with a dashed line in the drawing. Correction of curling applied by the winding rotary member is performed at the decurling unit 2. That is to say, the decurling unit 2 is a common unit which serves decurling in either path, provided between the sheet feeding unit 1 and the print unit 4 in the first path, and provided between the reverse unit 9 and the print unit 4 in the second path. The sheet of which both sides are inverted is fed to the print unit 4 via the skew correcting unit 3, where the back face of the sheet is printed. The printed sheet is fed to the cutter unit 6 via the inspection unit 5, and is cut at the cutter unit 6 for each predetermined unit length. With the cut sheet, both sides are printed, so recording at the information recording unit 7 is not performed. The cut sheet is conveyed to the drying unit 8 one sheet at a time, and is sequentially discharged and loaded in the discharge unit 12 of the sorter unit 11 via the discharge conveying unit 10.

In this way, with duplex printing, the sheet is processed passing through the first path, second path, first path, and third path in this order. If the above is summarized, with the duplex print mode, the following (1) through (11) sequence is executed by the control of the control unit 13, (1) Feed out the sheet from the sheet feeding unit 1 to feed to the print unit 4;
(2) Repeat printing of a unit image on the first surface of the fed sheet at the print unit 4;
(3) Pass the sheet of which the first surface is printed, through the drying unit 8;
(4) Lead the sheet passed through the drying unit 8 into the second path to wind the sheet around the winding rotary member included in the reverse unit 9;
(5) Cut the sheet at the cutter unit 6 at the end of the last printed unit image after repetition of printing as to the first surface;
(6) Wind the cut sheet around the winding rotary member until the edge portion of the cut sheet passes through the drying unit 8 and reaches the winding rotary member. Also, feed the sheet cut and left behind to the print unit 4 side, back to the sheet feeding unit 1;
(7) Rotate the winding rotary member in reverse after winding the sheet thereupon, and feed the sheet to the print unit 4 from the second path again;
(8) Repeat printing of a unit image on the second surface of the sheet fed from the second path at the print unit 4;
(9) Repeat cutting of the sheet at the cutter unit 6 for each unit image printed on the second surface;
(10) Pass the sheet cut for each unit image through the drying unit 8 one sheet at a time; and
(11) Discharge the sheet passed through the drying unit 8 to the discharge unit 12 through the third path one sheet at a time.

Figure 5:
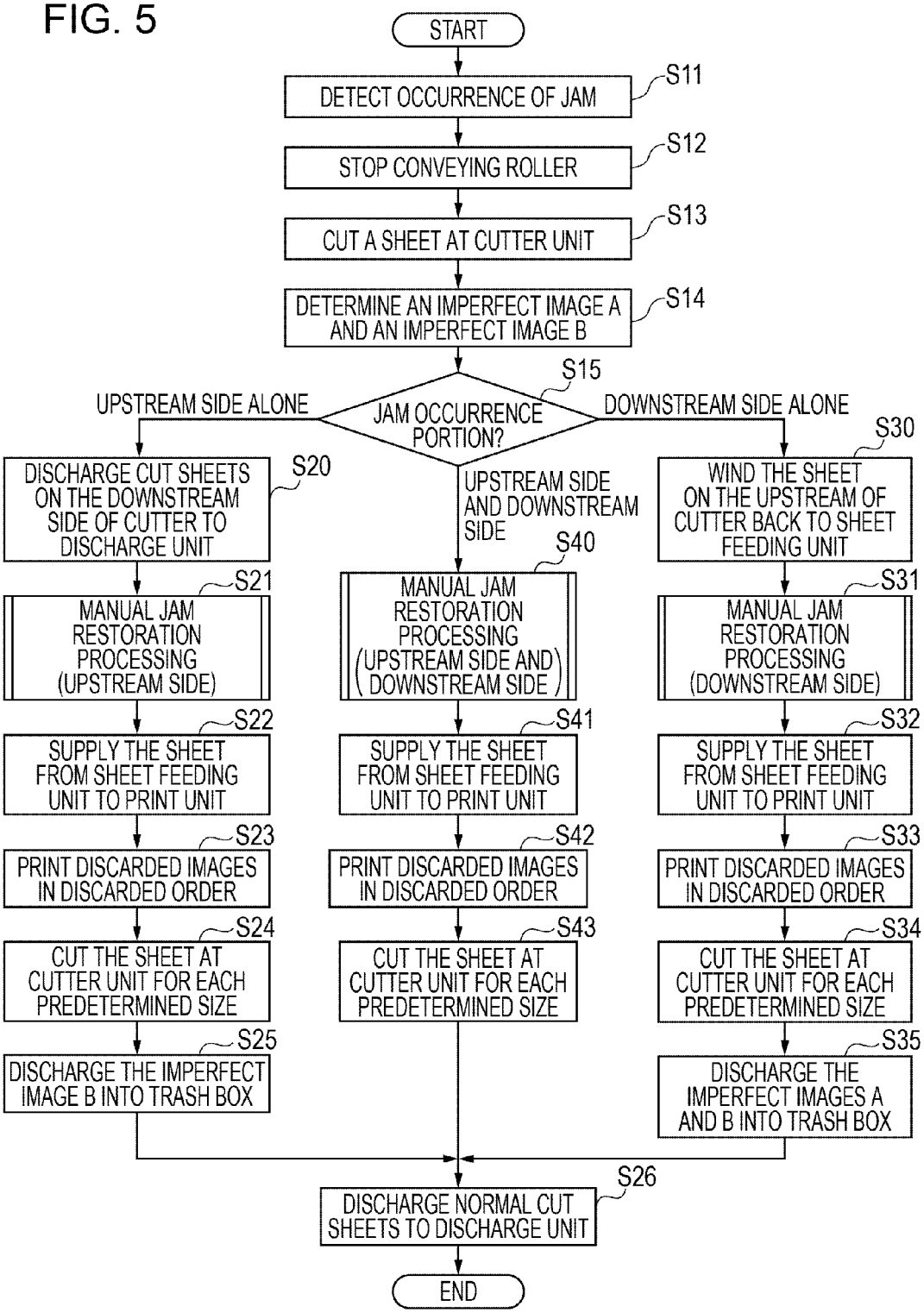
FIG. 5 is a flowchart illustrating restoration operation sequence in the simplex print mode.

Next, description will be made regarding restoration operation after occurrence of a jam at the printing apparatus having the above configuration. The procedure differs between the simplex print mode and the duplex print mode, so each will individually be described. Jam Restoration Operation in Simplex Print Mode FIG. 5 is a flowchart illustrating restoration operation sequence in the simplex print mode. This sequence is executed based on the control of the controller of the control unit 13.

In step S11, occurrence of a jam and the generate location of the jam are detected by a jam detecting unit. As for a method for detecting a jam, there are provided a method for detecting conveyance abnormality at the leading edge of a sheet, and a method for detecting conveyance abnormality in the middle of a sheet. With the former, the position information of a logical sheet leading edge calculated by the control information of the rollers, and the detection results of a sheet detection sensor installed between adjacent rollers are collated. In the event that no sheet leading edge has been detected at the sheet detection sensor within a period presumed that the sheet leading edge passes through, or in the event that detection extremely delays as to a theoretical value, this is determined to be occurrence of a jam. With the printing apparatus according to the present embodiment, the sheet detection sensor is provided to multiple positions of the sheet conveying path, and occurrence of a jam at each position can be detected. On the other hand, with the latter, when a continuous sheet moves to the sheet conveying path, in the event that a faulty sheet conveyance has occurred in a certain location, the speed of the portion thereof deteriorates, and the speed becomes zero in the worst case. Then, the subsequent sheet of the location where the speed has deteriorated is rapidly fed in and accumulated in a loop shape. As for a method for detecting this, in the event that deterioration in the rotational frequency of the motor of the conveying roller, or abnormality of motor load has occurred, this can be determined to be occurrence of a jam. As for another method, a direct sensor for directly measuring the movement state (speed or movement amount) of the sheet face is provided to multiple positions of the sheet conveying path, and in the event that abnormality of sheet conveyance speed has been detected, this can be determined to be occurrence of a jam. As for another method, in the event that with a location where the loop of a sheet is intentionally formed in the sheet conveying path, the size of the loop is detected with a sensor, and when the detected size differs from the true size, this can be determined to be occurrence of a jam.

Figure 8A:
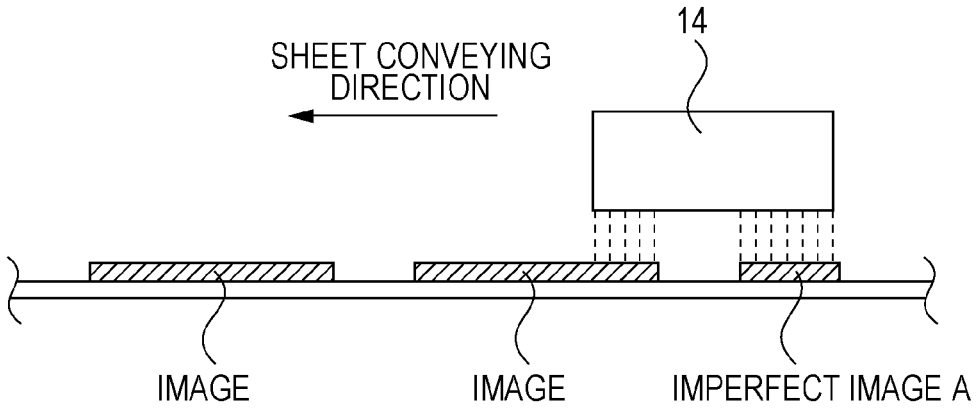
FIGS. 8A and 8B are diagrams for describing an imperfect image of an image to be caused due to occurrence of a jam.

In step S12, based on detection of occurrence of a jam, the driving motors of all of the conveying rollers relating to sheet conveyance of the sheet conveying path are stopped. This is for preventing influence of a jam from affecting others, by isolating the trouble in the location where the jam has occurred. If conveyance is stopped while a certain image is printed by the print head 14, as illustrated in FIG. 8A, an unfinished imperfect partial image (imperfect image A) occurs.

Figure 8B:
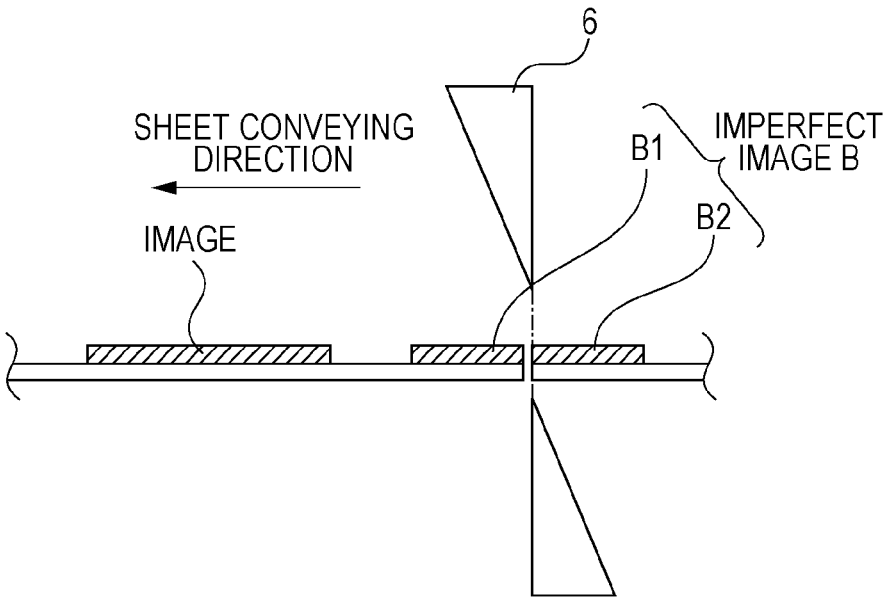

In step S13, the sheet of which the conveyance has been stopped is cut by the cutter unit 6. In the event that the sheet is cut when a certain image is positioned in the cut position of the cutter unit 6, as illustrated in FIG. 8B, the printed single image is divided into two (B1, B2), and an unfinished imperfect image (imperfect image B) occurs.

In step S14, it is determined by which image the imperfect image A and the imperfect image B have occurred. This is determined by calculation based on the position information of the sheet, and the layout information of the images (individual image size and alignment sequence) at the time of conveyance being stopped due to occurrence of a jam.

In step S15, determination is made whether the location where the jam has occurred is upstream alone from the cutter unit 6, or downstream alone, or both upstream and downstream. This determination is made based on the detecting results of the jam detecting unit. In the event of the upstream side alone, the flow proceeds to step S20, and in the event of the downstream side alone, proceeds to step S30, and in the event of the upstream and downstream sides, proceeds to step S40, respectively.

Note that step S13 is not essential but may be omitted. This is because, with simplex printing, sheet cutting is repeated for each unit image, so the sheet has already been cut in the neighborhood of the cutter unit 6 unless the sheet is cut again after occurrence of a jam has been detected.

(1-1) Jammed Upstream from the Cutter Unit

Figure 9A:
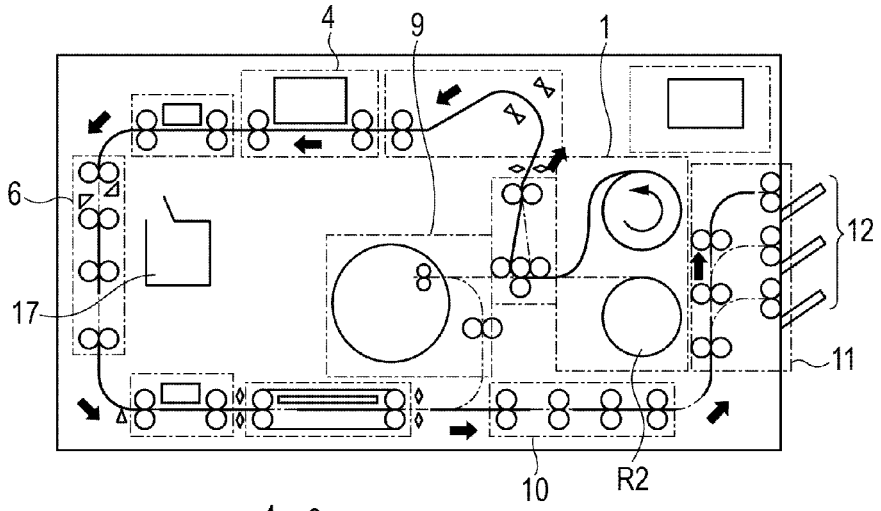
FIGS. 9A through 9C are diagrams for describing a restoration procedure in the event that a jam has occurred in the simplex print mode.
Figure 9B:
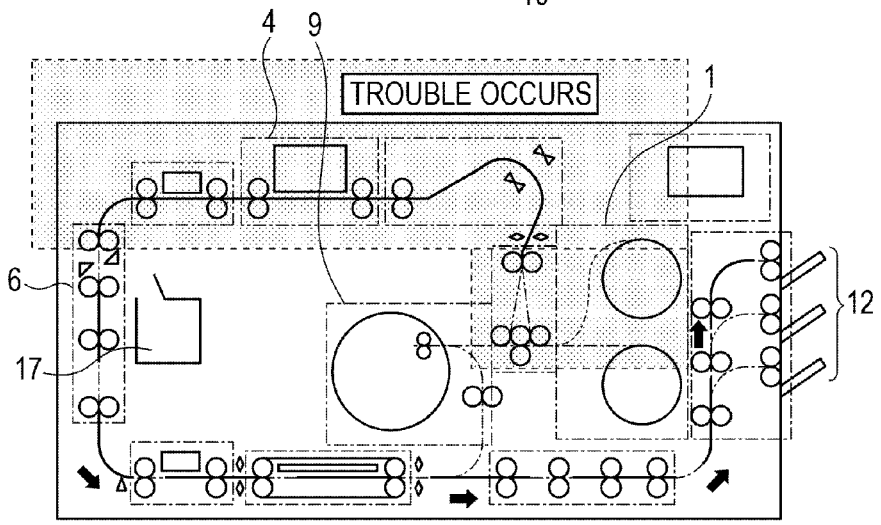

FIG. 9A illustrates the conveyance state of a sheet during simplex printing. At this time, as illustrated in FIG. 9B, let us assume a case where a jam has occurred in a path upstream from the cutter unit 6. A portion indicated with gray in the drawing is a region where a trouble has occurred, and the user has to remove and discard a sheet within this region.

In step S20, the sheets (cut sheets) left behind downstream from the cutter unit 6 are each processed at the information recording unit 7 and the drying unit 8 to discharge to the discharge unit 12 one sheet at a time. The discharged individual sheet is a correctly-printed completed article.

Figure 7:
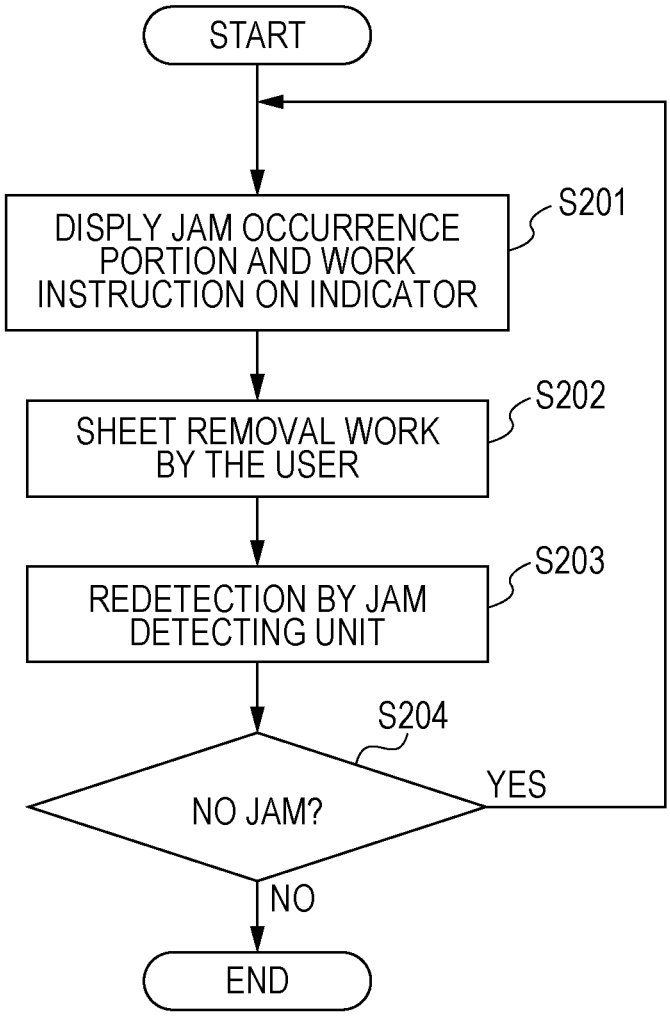
FIG. 7 is a flowchart illustrating the procedure of manual jam restoration processing by a user.
Figure 12:
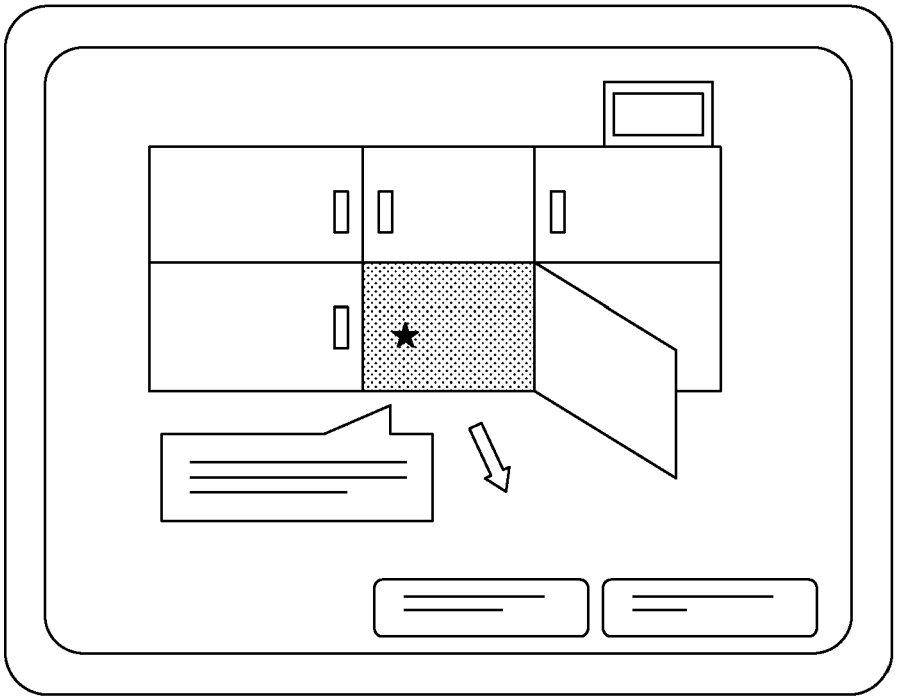
FIG. 12 is a display example of the location where the jam has occurred.

In step S21, the user manually performs manual jam restoration processing for removing the sheets on the upstream side. FIG. 7 is a flowchart illustrating the specific procedure of this sub routine. In step S201, the location where the jam has occurred, and operating instructions are displayed on the display of the operation unit 15 or host device 16 to prompt the user to perform manual jam restoration processing. That is to say, the user is prompted to perform manual jam restoration processing according to the location where the jam has occurred. FIG. 12 is an example to the display on the operation unit 15, where an operating location and an operating procedure are graphically displayed, caused by controlling of the control unit 13.

In FIG. 7, in step S202, the user performs a sheet removal operation for manually removing sheets. The user opens the front panel of the printing apparatus, and removes and discards sheets within a region where a trouble has occurred due to a jam. The manual cutter 18 is provided to multiple locations (three locations in this example) in the path to facilitate sheet removal operations, and the user cuts the sheet by the manual cutter 18 in the vicinity of a location where a jam has occurred to remove this. With the sheet removal operations, as illustrated in FIG. 12, the user opens the front lid corresponding to the unit in the vicinity of the location where the jam has occurred in the printing apparatus, and pulls out the unit thereof from the inner portion of the device to this side (arrow direction). At this time, if a continuous sheet is dragged by the unit, pulling out of the unit may be prevented, or if the sheet is forcedly dragged, the sheet or unit may be damaged. In order to prevent this, the unit is pulled out after the sheet is cut by the manual cutter 18 beforehand. Subsequently, the user takes out and removes unnecessary sheets form the path. Note that the locations where the manual cutter 18 is provided are not restricted to these three locations, and rather, the manual cutter 18 may be provided to at least one location somewhere in the conveying path. It is desirable that one location or more are provided to either of the upstream side and the downstream side of the cutter unit 6.

Upon sheet collection operations being completed, the user closes the front panel. In step S203, the jam detecting unit performs detection again after the front panel is closed. In the event that the jam detecting unit still detects a jam, the flow returns to step S201, where warning for prompting the user to perform manual jam restoration processing is issued again. In the event that the jam detecting unit has not detected a jam, this is regarded that the sheets have correctly been removed from the conveying path, the sub routine is ended, and the flow returns to the original routine.

Before the manual jam restoration processing, the sheets of a trouble-free region are discharged to the discharge unit 12, and there is no sheet in the conveying path, whereby the user can perform the manual jam restoration processing in a surer manner. Note that if some deterioration in workability is permissible, the orders of step S20 and step S21 may be inverted.

In step S22, the sheet is fed from the sheet feeding unit 1 to the print unit 4. In step S23, printing is resumed in order from the discarded images. There is the imperfect image B (divided image B1) at the leading edge of the sheet to be fed, caused due to cutting at the cutter unit 6, so printing is performed by avoiding this region.

In step S24, first, the imperfect image B of the sheet leading edge is cut off by the cutter unit 6. Subsequently, the printed sheet is cut for each predetermined unit length according to each image. In step S25, the sheet pieces of the cut-off imperfect image B are discharged to the trash box 17 as trash. In step S26, the cut sheets correctly subjected to duplex printing and cut are discharged to the discharge unit 12 one sheet at a time. In this way, the print sequence ends.

As described above, in the event that a jam has occurred upstream from the cutter unit 6, the sheet on the downstream side uninfluenced by the jam is not discarded, but rather discharged to the discharge unit 12 as a completed article. Thus, waste of sheets and ink can be reduced. Also, the sheets are discharged before the manual jam restoration processing, whereby the workability of the manual jam restoration processing can be improved.

(1-2) Jammed Downstream from the Cutter Unit

Figure 9C:
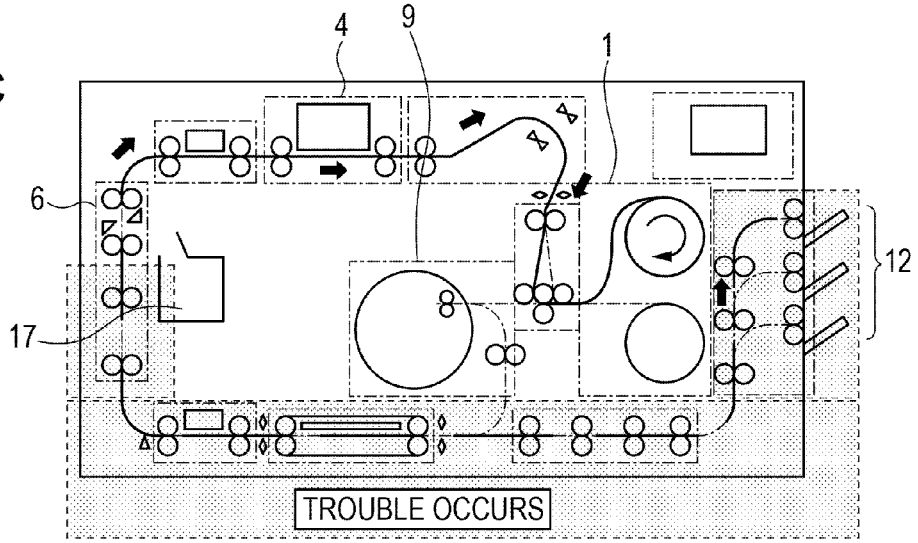

As illustrated in FIG. 9C, let us assume a case where a jam has occurred in the path downstream from the cutter unit 6. A portion indicated with gray in the drawing is a region where a trouble has occurred, and the user has to remove and discard a sheet within this region.

In step S30, the sheet (continuous sheet) left behind to upstream from the cutter unit 6 are fed back to be wound back to the sheet feeding unit 1. With the leading edge (range equivalent to the length from the print unit 4 to the cutter unit 6) of the wound back sheet, in order from the sheet leading edge side, there are arrayed an imperfect image B (divided image B2) caused due to cutting at the cutter unit 6, a correctly printed image (one or more), and an imperfect image A.

In step S31, the user performs the manual jam restoration processing for manually removing the sheet on the downstream side. The details are the same as described in FIG. 7.

In step S32, the sheet is fed from the sheet feeding unit 1 to the print unit 4. The reason why in step S30 the sheet is temporarily fed back to the sheet feeding unit 1, and in step S32 the sheet is fed out again is because a period used for the user performing the jam restoration processing operations is unknown, and it is necessary to prevent the sheet from being left behind to the sheet conveying path for a long time, which causes the sheet to be partially changed in quality. The change in quality means that unintended curling is applied to the sheet, or the sheet is in a partially humid or dry state. This is also because at the time of restarting printing, initialization operations of the units is more preferably performed in a state with no sheets. Further, this is to improve the user's workability of the manual jam restoration processing in step S31. If these are permissible, step S30 and step S32 may be omitted.

Printing is resumed from the image discarded in step S33 (the image of the imperfect image B) in order. With the leading edge of the sheet to be fed, there are arrayed the imperfect image B caused due to cutting at the cutter unit 6 (divided image B2), correctly printed image, and imperfect image A. These regions are preliminary fed, and printing is resumed from an unprinted portion of the sheet. The correct image between the imperfect image B and the imperfect image A may be used (excluded from reprinting), or all of up to the imperfect image A including this may be discarded together to be subjected to reprinting. With the present example, description will be made assuming that this correct image is used.

In step S34, first, the imperfect image B of the sheet leading edge is cut off at the cutter unit 6. Subsequently, the printed sheet is cut for each predetermined unit length according to an individual image. If the imperfect image A appears, this is cut off. Subsequently, cutting is repeated for each unit length. In step S35, the cut-off imperfect images A and B are discharged to the trash box 17 as trash. In step S26, the cut sheets correctly subjected to duplex printing and cut are discharged to the discharge unit 12 one sheet at a time. In this way, the print sequence ends.

As described above, in the event that a jam has occurred downstream from the cutter unit 6, printing is continued so as to use sheets on the upstream side uninfluenced by the jam, so waste of sheets and ink can be reduced. Also, the sheet is fed back to the sheet feeding unit 1 before the manual jam restoration processing, whereby workability of the jam restoration processing can be improved.

(1-3) Jammed both Upstream and Downstream from the Cutter Unit

A jam may occur at both the upstream and downstream at the same time, which is rare. In this case, it is difficult to reuse sheets in the conveying path, so the sheets within the device are all discarded.

In step S40, the user manually performs the manual jam restoration processing. The user manually removes all the sheets left behind to the upstream side and the downstream side. The details are the same as described in FIG. 7.

In step S41, the sheet is fed from the sheet feeding unit 1 to the print unit 4 again. In step S42, printing is performed sequentially from the images discarded in the jam restoration processing. The sheets discharged to the discharge unit 12 before a jam has occurred are correctly printed completed articles. Accordingly, with reprinting after jam restoration, the image next to the correctly printed images and thereafter are printed in order, whereby print results in the original order are obtained. In step S43, the sheet subjected to printing is cut for each predetermined unit length according to an individual image. In step S26, the cut sheets correctly printed and cut are discharged to the discharge unit 12 one sheet at a time. In this way, the print sequence ends.

Jam Restoration Operation in Duplex Print Mode

Figures 6, 6A:
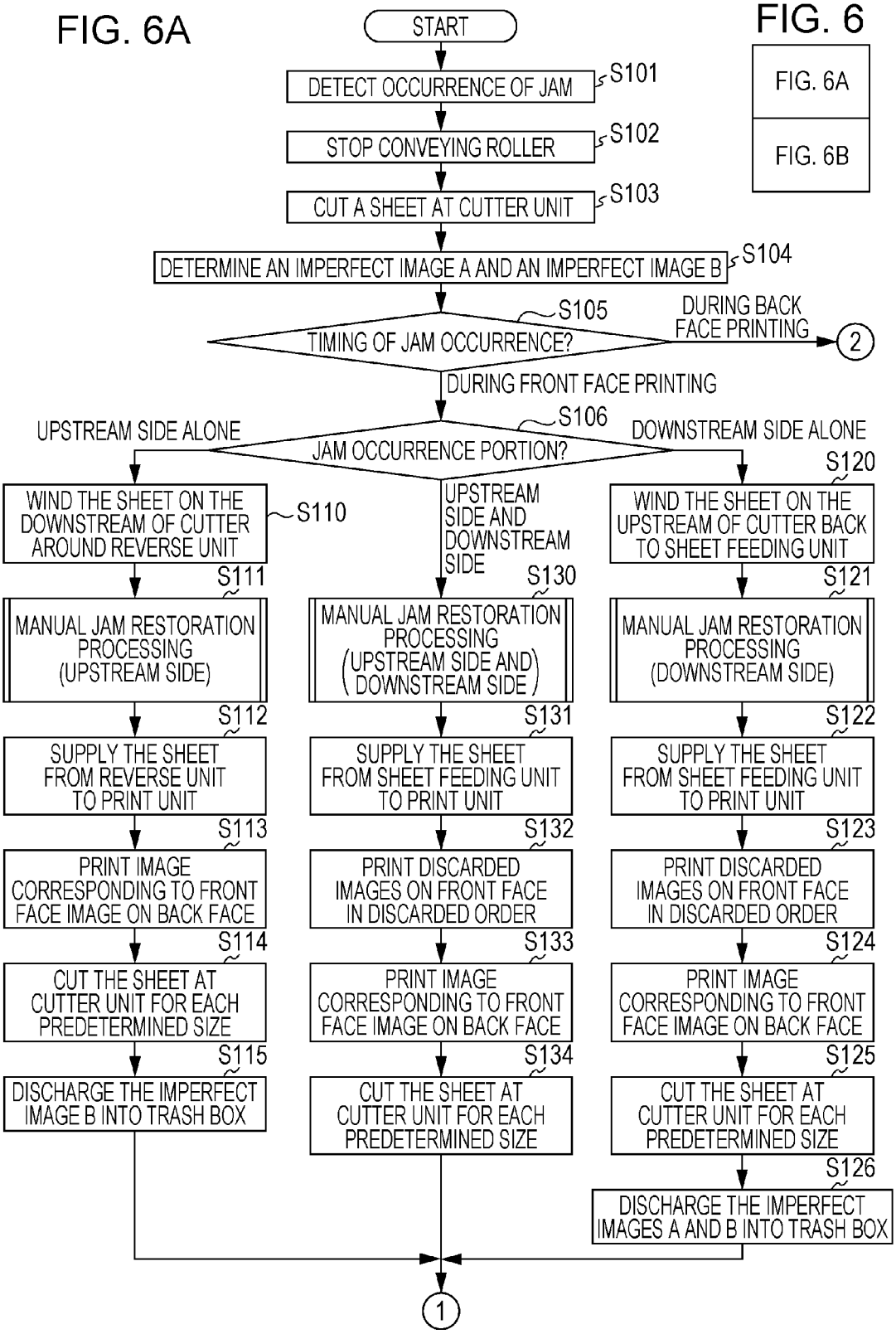
FIG. 6 is a flowchart illustrating restoration operation sequence in the duplex print mode.
Figure 6B:
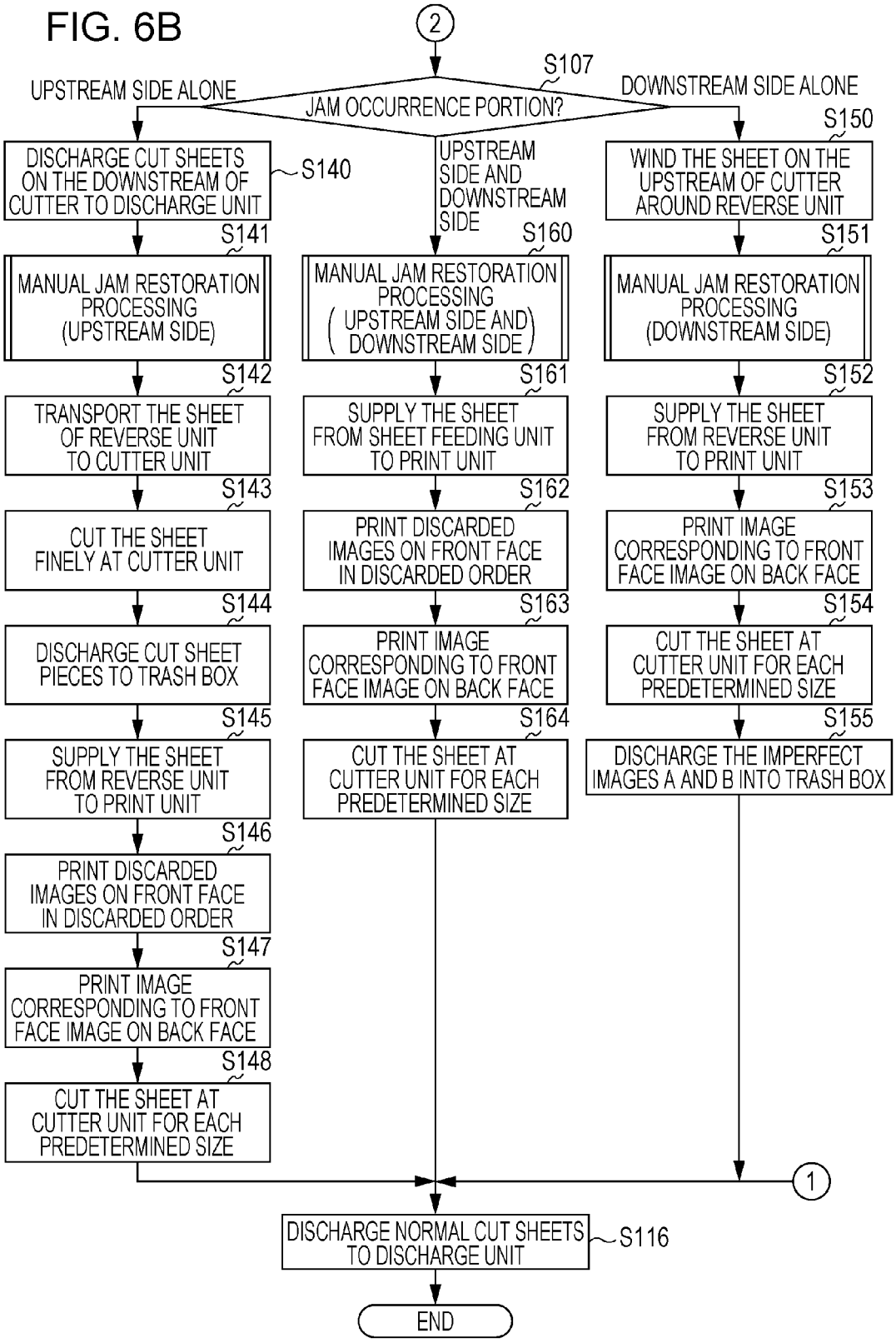

Next, restoration operation after occurrence of a jam with duplex printing will be described. FIG. 6 is a flowchart illustrating the sequence of restoration operation in the duplex print mode. This sequence is executed based on the controller of the control unit 13.

In step S101, occurrence of a jam is detected. Upon occurrence of a jam being detected, in step S102 the driving motors of all of the conveying rollers relating to sheet conveyance of the sheet conveying path are stopped. In step S103, the sheet of which the conveyance has been stopped is cut at the cutter unit 6.

Note that in the event of back face printing with duplex printing, step S103 is not essential and may be omitted. This is because, with back face printing, sheet cutting is repeated for each unit image, so even if the sheet is not cut again after occurrence of a jam has been detected, the sheet has already been cut in the vicinity of the cutter unit 6.

In step S104, it is determined by which image the imperfect image A and the imperfect image B have occurred. So far the steps are the same as steps S11 through S14 in the previous FIG. 5.

In step S105, determination is made whether the timing of occurrence of a jam is during front face printing or during back face printing. In the event of during front face printing, the flow proceeds to step S106, and in the event of during back face printing, the flow proceeds to step S107. In steps S106 and S107, determination is made whether the location where the jam has occurred is the upstream side or downstream side of the cutter unit, or both of the upstream and downstream. This judgment is performed based on the detection results of the jam detecting unit.

The specific jam restoration processing differs depending on the timing or location where the jam has occurred. Description will be made by being classified such as the following. Steps S105 through S107 are for determining which case of the following;

during Front Face Printing;

(2-1-1) Jammed upstream from the cutter unit;

(2-1-2) Jammed downstream from the cutter unit;

(2-1-3) Jammed both upstream and downstream from the cutter unit;

during Back Face Printing;

(2-2-1) Jammed upstream from the cutter unit;

(2-2-2) Jammed downstream from the cutter unit;

(2-2-3) Jammed both upstream and downstream from the cutter unit; and (2-1-1) Jammed upstream from the cutter unit during front face printing.

Figure 10A:
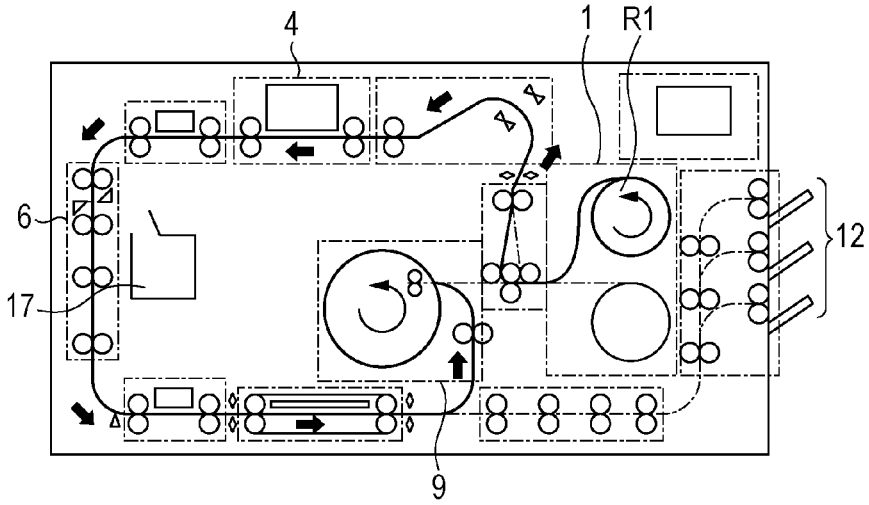
FIGS. 10A through 10C are diagrams for describing a restoration procedure in the event that a jam has occurred during front face printing in the duplex print mode.
Figure 10B:
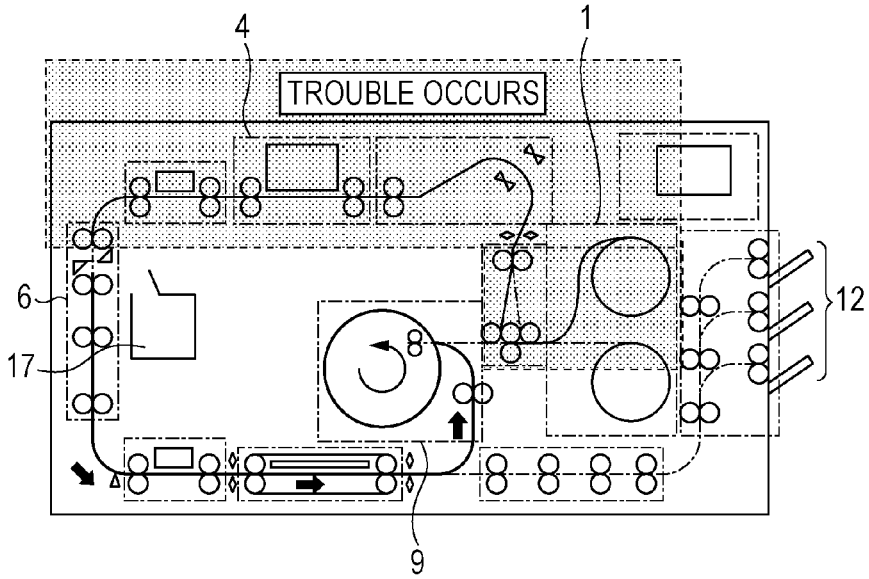

FIG. 10A illustrates the conveying state of a sheet being subjected to front face printing. At this time, as illustrated in FIG. 10B, let us assume a case where a jam occurs in the path upstream from the cutter unit 6. A portion indicated with gray in the drawing is a region where a trouble has occurred, and the user has to remove and discard a sheet within this region.

In step S110, the sheet (continuous sheet) left behind downstream from the cutter unit 6 is fed back in the direction indicated with an arrow in FIG. 10B, and stored by being wound around the reverse unit 9. With this region, front face printing has correctly been performed, so the sheet wound around the reverse unit 9 can be reused.

In step S111, the user manually performs the manual jam restoration processing for removing a sheet on the upstream side. The details are the same as described in FIG. 7. A sheet in a trouble-free region has been wound around the reverse unit 9 before the manual jam restoration processing, and there is no sheet in the conveying path, whereby the user can the manual jam restoration processing in a surer manner. Note that if some deterioration in workability is permissible, the orders of step S110 and step S111 may be inverted.

In step S112, the sheet wound around the reverse unit 9 is fed to the print unit 4. The sheet is fed with both sides being reversed, so the second surface side of the sheet faces the print head 14.

In step S113, the image corresponding to the position corresponding to the printed front face is sequentially subjected to back face printing. There is the imperfect image B (divided image B1) caused due to cutting at the cutter unit 6 on the leading edge of the first surface of the sheet to be fed, so back face printing is performed by avoiding the portion corresponding to the region thereof.

In step S114, first, the imperfect image B of the sheet leading edge is cut off by the cutter unit 6. Subsequently, the printed sheet is cut for each predetermined unit length according to each image. In step S115, the sheet pieces of the cut-off imperfect image B are discharged to the trash box 17 as trash. In step S116, the cut sheets correctly subjected to duplex printing and cut are discharged to the discharge unit 12 one sheet at a time. In this way, the print sequence ends.

As described above, in the event that a jam has occurred upstream from the cutter unit 6 during front face printing, the sheet on the downstream side uninfluenced by the jam is not discarded but wound around the reverse unit 9, and printing of the wound sheet is completed. Thus, waste of sheets and ink can be reduced. Also, the sheet is wound around the reverse unit 9 before the manual jam restoration processing, whereby workability of the jam restoration processing can be improved.

(2-1-2) Jammed Downstream from the Cutter Unit During Front Face Printing

Figure 10C:
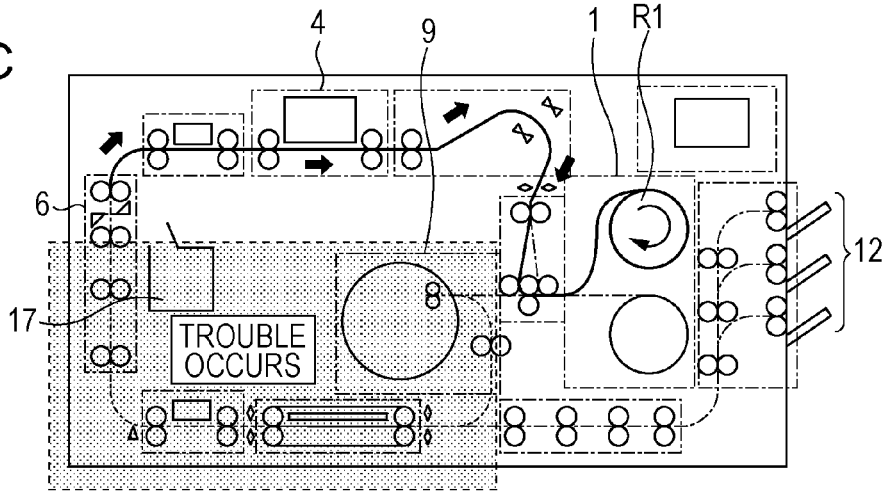

As illustrated in FIG. 10C, let us assume a case where a jam occurs in the path downstream from the cutter unit 6. A portion indicated with gray in the drawing is a region where a trouble has occurred, and the user has to remove and discard a sheet within this region.

In step S120, the sheet (continuous sheet) left behind upstream from the cutter unit 6 is fed back to be wound back to the sheet feeding unit 1. With the leading edge (range equivalent to the length from the print unit 4 to the cutter unit 6) of the wound back sheet, in order from the sheet leading edge side, there are arrayed an imperfect image B (divided image B2) caused due to cutting at the cutter unit 6, a correctly printed image (one or more), and an imperfect image A.

In step S121, the user performs the manual jam restoration processing for manually removing the sheet on the downstream side. The details are the same as described in FIG. 7.

In step S122, the sheet is fed from the sheet feeding unit 1 to the print unit 4. The reason why in step S120 the sheet is temporarily fed back to the sheet feeding unit 1, and in step S122 the sheet is fed out again is the same as described above. Step S120 and step S122 may be omitted.

Front face printing is resumed from the image discarded in step S123 (the image of the imperfect image B) in order. With the leading edge of the sheet to be fed, there are arrayed the imperfect image B caused due to cutting at the cutter unit 6 (divided image B2), correctly printed image, and imperfect image A. These regions are preliminary fed, and front face printing is resumed from an unprinted portion of the sheet. The correct image between the imperfect image B and the imperfect image A may be used (excluded from reprinting), or all of up to the imperfect image A including this may be discarded together to be subjected to reprinting. With the present example, description will be made assuming that this correct image is used.

In step S124, the sheet subjected to front face printing and reversed at the reverse unit 9 is subjected to back face printing. With back face printing, the image corresponding to the front face image is sequentially printed in the back face position of the printed front face image. There are the imperfect images A and B on the front face, so back face printing is performed by avoiding the regions thereof.

In step S125, the printed sheet is cut for each predetermined unit length according to an individual image. With regard to the imperfect images A and B, only the portions thereof are cut off. In step S126, the sheet pieces of the cut-off imperfect images A and B are discharged to the trash box 17 as trash. In step S116, the cut sheets correctly printed and cut are discharged to the discharge unit 12 one sheet at a time. In this way, the print sequence ends.

As described above, in the event that a jam has occurred downstream from the cutter unit 6 during front face printing, printing is continued by using the sheet on the upstream side uninfluenced by the jam as much as possible, whereby waste of sheets and ink can be reduced.

(2-1-3) Jammed Both Upstream and Downstream from the Cutter Unit During Front Face Printing A jam may occur in both of the upstream and downstream at the same time during front face printing, which is rare. In this case, it is difficult to reuse sheets in the conveying path, so the sheets within the device are all discarded.

In step S130, the user performs the manual jam restoration processing to manually remove all the sheets left behind to the upstream and downstream sides. The details are the same as described in FIG. 7.

In step S131, the sheet is fed from the sheet feeding unit 1 to the print unit 4 again. In step S132, front face printing is performed sequentially from the images discarded in the jam restoration processing. In step S133, the sheet subjected to front face printing and reversed at the reverse unit 9 is subjected to back face printing. With back face printing, the image corresponding to the position corresponding to the printed front face image is sequentially printed on the back face. In step S134, the printed sheet is cut for each predetermined unit length according to an individual image. In step S116, the cut sheets are discharge to the discharge unit 12 one sheet at a time. In this way, the print sequence ends.

(2-2-1) Jammed Upstream from the Cutter Unit During Back Face Printing

Figure 11A:
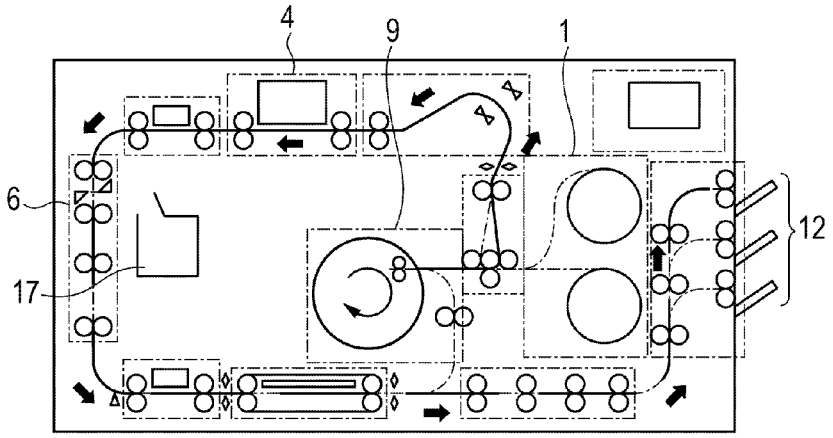
FIGS. 11A through 11C are diagrams for describing a restoration procedure in the event that a jam has occurred during back face printing in the duplex print mode.
Figure 11B:
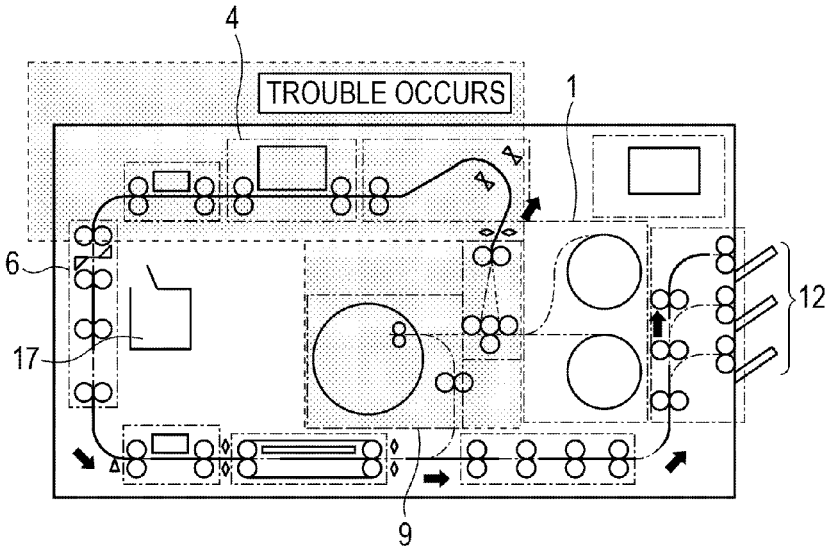

FIG. 11A illustrates the conveying state of a sheet being subjected to back face printing. At this time, as illustrated in FIG. 11B, let us assume a case where a jam occurs in the path upstream from the cutter unit 6. A portion indicated with gray in the drawing is a region where a trouble has occurred, and the user has to remove and discard a sheet within this region.

In step S140, the sheets (cut sheets) left behind downstream from the cutter unit 6 are processed at the information recording unit 7 and drying unit 8, and discharged to the discharge unit 12 one sheet at a time. The individual sheet to be discharged is a correctly printed completed article. The flow proceeds to step S141.

In step S141, the user performs the manual jam restoration processing for manually removing a sheet on the upstream side. The details are the same as described in FIG. 7. Before the manual jam restoration processing, the sheets of a trouble-free region are discharged to the discharge unit 12, and there is no sheet in the conveying path, whereby the user can perform the manual jam restoration processing in a surer manner. Note that if some deterioration in workability is permissible, the orders of step S140 and step S141 may be inverted.

The sheets in the conveying path have been removed by the manual jam restoration processing, but the remaining sheets are still wound around the reverse unit 9. The user does not know that the leading edge of a sheet corresponds to which image by operations, so the sheets of the reverse unit 9 are all discarded. In step S142, the sheets wound around the reverse unit 9 are fed out again to be passed through the print unit 4, and are conveyed to the cutter unit 6. In step S143, all the sheets to be fed from the reverse unit 9 are finely cut up by the cutter unit 6. In step S144, the cut-out sheet pieces are discharged to the trash box 17 as trash.

Subsequently, duplex printing is started from the front face again. In step S145, the sheet is fed form the sheet feeding unit 1 to the print unit 4. In step S146, front face printing is repeated sequentially from the discarded images. In step S147, the sheet subjected to front face printing and reversed at the reverse unit 9 is subjected to back face printing. With back face printing, the image corresponding to the front face image is sequentially printed in the back face position of the printed front face image. In step S148, the sheet subjected to printing is cut for each predetermined unit length according to an individual image. In step S116, the cut sheets correctly printed and cut are discharged to the discharge unit 12 one sheet at a time. In this way, the print sequence ends.

As described above, in the event that a jam has occurred upstream from the cutter unit 6 during back face printing, the sheet on the downstream side uninfluenced by the jam is not discarded but discharged to the discharge unit 12 as a completed article. Thus, waste of sheets and ink can be reduced. Also, the sheet is discharged before the manual jam restoration processing, whereby workability of the manual jam restoration processing can be improved.

(2-2-2) Jammed Downstream from the Cutter Unit During Back Face Printing

Figure 11C:
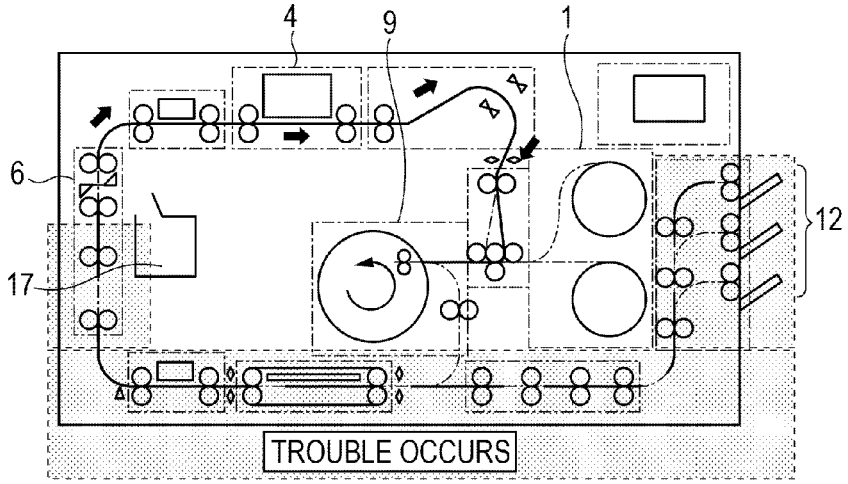

As illustrated in FIG. 11C, let us assume a case where a jam occurs in the path downstream from the cutter unit 6. A portion indicated with gray in the drawing is a region where a trouble has occurred, and the user has to remove and discard a sheet within this region.

In step S150, the sheet (continuous sheet) left behind upstream from the cutter unit 6 is fed back in the direction indicated with an arrow in FIG. 11C and stored by being wound around the reverse unit 9. With this region, front face printing has correctly been performed, so the sheet wound around the reverse unit 9 can be reused.

In step S151, the user performs the manual jam restoration processing for manually removing the sheet on the upstream side. The details are the same as described in FIG. 7.

In step S152, the sheet wound around the reverse unit 9 is fed to the print unit 4. The sheet is fed with both sides being reversed, so the second surface side of the sheet faces the print head 14. The reason why in step S150 the sheet is temporarily fed back to the reverse unit 9, and in step S152 the sheet is fed out again is the same as described above. Step S150 and step S152 may be omitted.

In step S153, the sheet subjected to front face printing is subjected to back face printing. With back face printing, the image corresponding to the front face image is sequentially printed in the back face position of the printed front face image. With the leading edge of the sheet, there are the imperfect image B, and the imperfect image A with predetermined distance therebetween, so back face printing is performed by avoiding the regions thereof.

In step S154, the printed sheet is cut for each predetermined unit length according to an individual image. With regard to the imperfect images A and B, only the portions thereof are cut off. In step S155, the sheet pieces of the cut-off imperfect images A and B are discharged to the trash box 17 as trash. In step S116, the cut sheets correctly printed and cut are discharged to the discharge unit 12 one sheet at a time. In this way, the print sequence ends. Note that, with the present sequence, the sheets of the images of the imperfect images A and B fall out of the completed series of cut sheets, so these will be added to the next duplex print job.

As described above, in the event that a jam has occurred downstream from the cutter unit 6 during back face printing, printing is continued by using the sheet on the upstream side uninfluenced by the jam as much as possible, whereby waste of sheets and ink can be reduced. Also, the sheet is fed back to the reverse unit 9 before the manual jam restoration processing, whereby the workability of the jam restoration processing can be improved.

(2-2-3) Jammed Both Upstream and Downstream from the Cutter Unit During Back Face Printing A jam may occur at both upstream and downstream at the same time during back face printing, which is rare. In this case, it is difficult to reuse sheets in the conveying path, so the sheets within the device are all discarded. The processing in steps S160 through S164 is the same as the above processing in steps S130 through S134, so redundant description will be omitted.

Initial operations after occurrence of a jam are organized in Table 1.

TABLE 1

| MODE | TIMING OCCURRED | JAM LOCATION | OPERATION AFTER JAM OCCURRENCE | OPERATION AFTER CUTTING BY CUTTER |
|---|---|---|---|---|
| SIMPLEX PRINT MODE | DURING FRONT FACE PRINTING | CUTTER UPSTREAM | SHEET CUTTING BY CUTTER (OMISSIBLE) | DOWNSTREAM CUT SHEETS ARE DISCHARGED TO DISCHARGE UNIT 12 |

TABLE 1-continued

| MODE | TIMING OCCURRED | JAM LOCATION | OPERATION AFTER JAM OCCURRENCE | OPERATION AFTER CUTTING BY CUTTER |
|---|---|---|---|---|
| | | CUTTER DOWNSTREAM | | UPSTREAM CONTINUOUS SHEET IS WOUND AROUND SHEET FEEDING UNIT 1 (OMISSIBLE) |
| | | UPSTREAM AND DOWNSTREAM | | NONE |
| DUPLEX PRINT MODE | DURING FRONT FACE PRINTING | CUTTER UPSTREAM | SHEET CUTTING BY CUTTER | DOWNSTREAM CONTINUOUS SHEET IS WOUND AROUND REVERSE UNIT 9 |
| | | CUTTER DOWNSTREAM | | UPSTREAM CONTINUOUS SHEET IS WOUND AROUND SHEET FEEDING UNIT 1 (OMISSIBLE) |
| | | UPSTREAM AND DOWNSTREAM | | NONE |
| | DURING BACK FACE PRINTING | CUTTER UPSTREAM | SHEET CUTTING BY CUTTER (OMISSIBLE) | DOWNSTREAM CUT SHEETS ARE DISCHARGED TO DISCHARGE UNIT 12 |
| | | CUTTER DOWNSTREAM | | UPSTREAM CONTINUOUS SHEET IS WOUND AROUND REVERSE UNIT 9 (OMISSIBLE) |
| | | UPSTREAM AND DOWNSTREAM | | NONE |

As described above, in the event that occurrence of a jam has been detected, the sheet is cut at the cutter unit, and the user is prompted to perform the manual jam restoration processing according to the location where the jam has occurred. The sheet is cut at the cutter unit, and accordingly, the sheet is divided into a region where a trouble including the location where the jam has occurred has occurred, and a region where no trouble other than this has occurred. Thus, the user can concentrate his/her operations on the region where the trouble has occurred, and can perform jam restoration processing effectively with little effort and time. Also, a sheet of the region where no trouble has occurred can be used without being discarded, and accordingly, waste of sheets and ink can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042344 filed Feb. 26, 2010, which is hereby incorporated by reference herein in its entirety.

What is claimed is:

1. An apparatus for duplex printing, comprising:

a sheet feeding unit configured to feed a sheet, wherein the sheet is continuous;

a print unit configured to perform printing on the sheet;

a detecting unit configured to detect a jam occurred when the sheet is being conveyed;

a reverse unit configured to reverse the sheet printed at the print unit for the duplex printing;

a cutter unit, disposed between the print unit and the reverse unit in a sheet conveying path, configured to cut the sheet on which a plurality of images are printed at the print unit; and a control unit;

wherein the control unit controls so that, in the duplex printing, the printing unit performs printing of a plurality of images in sequence on a first surface of the sheet fed from the sheet feeding unit, the cutter unit cuts the sheet at a trailing end of the printed images, the cut sheet is reversed by the reverse unit to feed the reversed sheet to the printing unit, the printing unit performs printing of a plurality of images in sequence on a second surface that is a back of the first surface of the sheet fed from the reverse unit, and the cutter unit cuts the sheet into a plurality of cut sheets, and wherein, in the event that the detecting unit detects the jam during printing on the first surface, the printing unit stops printing then the cutter unit cuts the sheet, and the control unit displays a location where the jam has occurred on a display to prompt a user to perform jam restoration processing.

2. A apparatus according to claim 1, wherein, in the duplex printing, in the event of determining that the jam has occurred downstream from the cutter unit and has not occurred upstream during printing on the first surface, the sheet left upstream is fed back to the sheet feeding unit, and wherein, in the event of determining that the jam has occurred downstream from the cutter unit and has not occurred upstream during printing on the second surface, the sheet left upstream is fed back to the reverse unit.

3. The apparatus according to claim 2, wherein, in the duplex printing, in the event of determining that the jam has occurred upstream from the cutter unit and has not occurred downstream during printing to the first surface, the sheet left downstream is fed back to the reverse unit and stored, and wherein, in the event of determining that the jam has occurred upstream from the cutter unit and has not occurred downstream during printing to the second surface, the sheet left downstream is discharged.

4. The apparatus according to claim 1, wherein the control unit causes to display the location where the jam has occurred on a display to prompt the user to perform the jam restoration processing.

5. The apparatus according to claim 1, wherein a manual cutter for a user to manually cut a sheet is provided to at least one location apart from the cutter unit.

6. The apparatus according to claim 5, wherein the manual cutter is provided to multiple places of an upstream path from the cutter unit, and is provided to multiple places of a downstream path from the cutter unit.

7. The apparatus according to claim 1, wherein after the jam restoration processing is performed, the control unit controls to resume printing from images discarded in the jam restoration processing.

8. The apparatus according to claim 1, wherein the control unit controls such that an imperfect image which occurs due to the cutter unit cutting the printed image along with occurrence of the jam is cut off by the cutter to be discharged as trash.

* * * * *